United States Patent [19]

Austin

[11] 4,304,327

[45] Dec. 8, 1981

[54] CONTAINER UNITIZER SLEEVE AND SUPPORT

[75] Inventor: John J. Austin, LaGrange, Ill.

[73] Assignee: Champion International Corporation, Stamford, Conn.

[21] Appl. No.: 113,757

[22] Filed: Jan. 21, 1980

[51] Int. Cl.[3] ..... B65D 5/36; B65D 5/54; B65D 75/02; B65D 85/62

[52] U.S. Cl. ..... 206/44 R; 206/499; 206/503; 206/526; 206/45.11

[58] Field of Search ..... 206/526, 45.31, 45.11, 206/44 R, 44 K, 45.24, 45.27, 499, 503; 426/119, 124, 130; 229/41 D; 220/4 E

[56] References Cited

U.S. PATENT DOCUMENTS

| | | | |
|---|---|---|---|
| 1,604,926 | 10/1926 | MacDonald | 206/820 |
| 1,625,033 | 4/1927 | Knopp | 229/45 |
| 1,683,542 | 9/1928 | Greenwood | 206/499 |
| 1,856,634 | 5/1932 | Hartig | 426/124 |
| 2,062,539 | 12/1936 | Vogt | 426/130 |
| 2,085,238 | 6/1937 | Towell | 229/41 D |
| 2,133,336 | 10/1938 | Ziemmerman | 206/44 K |
| 2,141,743 | 12/1938 | Ethridge | 206/45.11 |
| 2,572,610 | 10/1951 | Gilbert | 229/41 D |
| 3,065,848 | 11/1962 | Kuflik | 206/45.27 |
| 3,145,112 | 8/1964 | Boegershausen | 426/130 |
| 3,189,170 | 6/1965 | Elliott, Jr. | 206/44 R |
| 3,292,810 | 12/1966 | Schechter | 220/4 E |
| 3,357,543 | 12/1967 | Taggart | 206/45.31 |
| 3,861,530 | 1/1975 | Caluert | 206/499 |

*Primary Examiner*—William T. Dixson, Jr.
*Attorney, Agent, or Firm*—Evelyn M. Sommer

[57] ABSTRACT

A binder sleeve to hold a pair of containers together as a unitized package and for supporting the containers above a plane surface includes a tube formed from an endless paperboard strip which can be separated along a central perforated score line into two pieces, each having a linear edge and an opposed undulating edge. The sleeve is placed around a pair of containers, held in face-to-face juxtaposition, to form the unitized package for marketing. Upon disassembly of the package and separation of the sleeve, the linear edge of one of the sleeve halves can be placed on a plane support surface and one of the containers supported in spaced relation above the surface on the undulating edge. This is particularly useful where the container contains a food to be cooked in a microwave oven, as the energy can be evenly distributed about the food in the container.

6 Claims, 7 Drawing Figures

CONTAINER UNITIZER SLEEVE AND SUPPORT

BACKGROUND OF THE INVENTION

1. Field of the Invention

This invention relates to a fastener band or sleeve for holding a pair of containers in face-to-face relation to form a unitary package, and a sleeve which can also function as a support for at least one of the containers to maintain the container in an elevated condition above a plane surface.

2. Description of the Prior Art

In our copending patent applications entitled "EXPANDABLE FOOD PACKAGE CONTAINER", Ser. No. 116,911, filed Jan. 30, 1980, now allowed, and "COMBINATION PACKAGE AND SLEEVE MEANS", now U.S. Pat. No. 4,248,901, we disclosed a paperboard container for housing an expandable food bag or package in an unexpanded, stored condition and in an expanded condition having a substantially increased volume. Specifically, the food bag can contain corn kernels and cooking oil for forming popcorn.

The container, which forms no part of the present invention, consisted of a base portion in the shape of a regular polygon, preferably an octagon. Trapezoidal side panels extend outwardly and upwardly from the edges of the base portion and are foldably connected to an integral pop-up cover comprising a plurality of overlapped, separate semi-ovoid shaped top panels foldably connected to each of the side panels. One of the top panels includes a central, circular seal which is releasably attached to one of the remaining top panels to keep the cover closed. When the seal is removed, the semi-ovoid shaped top panels spring to an upright position to aid in housing the expanded food package, which is heated in a microwave oven.

This container is especially useful for heating and expanding food, such as popcorn, in a microwave oven since it is made of paperboard or a paperboard lamination, having no metallic elements or components to interfere with the absorption of the microwave energy and heat.

The sleeve and fastener band of the present invention is used to retain a pair of the aforementioned containers in face-to-face relationship to form an integral package or unit which can be marketed as such. In other words, the sleeve serves as a package initizer for a pair of identical containers which could be sold as a "twin-pack". Additionally, once the sleeve or band is disassembled from the container package and the container is ready for use in the microwave oven, the sleeve can be used to support the base portion of the container above the plane of the microwave oven walls enabling the base portion to be exposed to the microwave energy. This better distribution of microwave energy about the product increases the volume and quality of the expanded product.

SUMMARY OF THE INVENTION

In accordance with the invention, the band or unitizing sleeve serves to hold a pair of containers together in face-to-face juxtaposition.

The sleeve comprises a tube formed from an endless paperboard strip which can be separated along a central perforated score line into two pieces, each having a linear edge and an opposed undulating edge. The linear edge is provided by the perforated score line. The undulating edges of the sleeve constitute a series of peaks and valleys and at least one pair of opposed portions thereof are in the shape of a regular polygon complemental in shape to the polygonal shape of the base portion of one of the containers bound by the sleeve. The regular polygonal portions of the sleeve are connected by trapezoidal sections joined along a common base.

When a pair of containers are placed in face-to-face juxtaposition, they can be unitized in a single package by a binder sleeve of the present invention which is slipped over and around the face-to-face containers. The regular polygonal portions of the sleeve seat on the base portions of the containers, while the trapezoidal portions are complemental in shape to and encompass the side walls of the container.

Once each band is removed and the containers are to be utilized in a microwave oven, the band is split along its central score line and the linear edge of one-half of the tubular sleeve is placed on the plane support surface of the microwave oven. The base portion of a container is then supported upon the undulating edge of the band half disposed above the plane surface of the oven so that the microwave energy can be distributed beneath the container for enhancement of the quality and volume of the cooked product.

BRIEF DESCRIPTION OF THE DRAWINGS

Further objects and advantages of the invention will become apparent from the following description and claims, and from the accompanying drawing, wherein:

DETAILED DESCRIPTION OF THE PREFERRED EMBODIMENT

Figure 4:
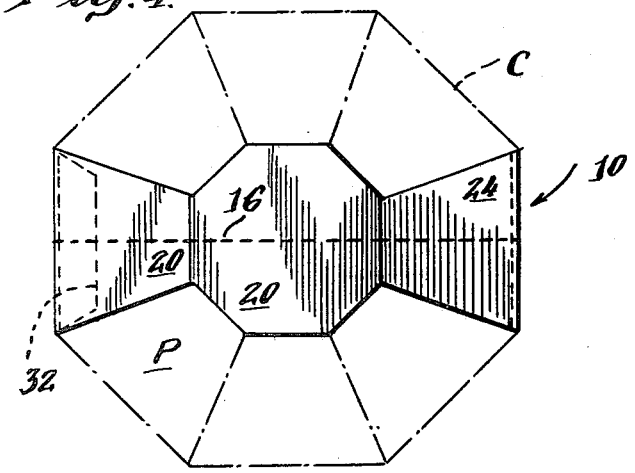
FIG. 4 is a top plan view of the sleeve of FIG. 3 in place about a pair of juxtaposed containers illustrated in phantom, to form a container package.
Figure 5:
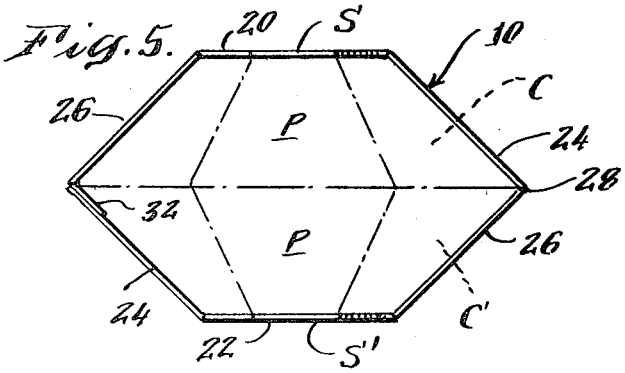
FIG. 5 is a side view in elevation of the sleeve of FIG. 4.

Referring now to the drawing in detail, wherein like numerals indicate like elements throughout the several views, the binder sleeve 10 of the present invention is illustrated in FIGS. 4 and 5 holding a pair of containers C and C′ together in face-to-face juxtaposition.

The sleeve 10 comprises an annular tube formed from an endless paperboard strip 14 having opposed undulating edges 12 and 18. A central, linear perforated score line 16 bisects strip 14 and is equidistant from edges 12 and 18. Endless paperboard strip 14 is inserted over a pair of containers C and C′ as indicated in FIGS. 4 and 5 to hold them together. Strip 14 is inserted around the container package comprising the containers C and C′ which are placed in face-to-face juxtaposition.

Opposed panels 20 and 22 between the undulating edges 12 and 18 are shaped so as to conform to the regular polygonal shaped bottom panel of each container C and C'. In the embodiment illustrated, the panels 20 and 22 are octagonal in shape as are the bottom support panels S and S' of each container C and C', respectively.

Panels 24 and 26 between the octagonal panels 20 and 22 are also chosen so as to be of a length to approximate the length of the side panels P of each of the containers C and C' and also are complemental in shape thereto. In the example shown, the panels 24 and 26 are trapezoidal in shape and are joined along a common fold or score line 28.

Figure 1:
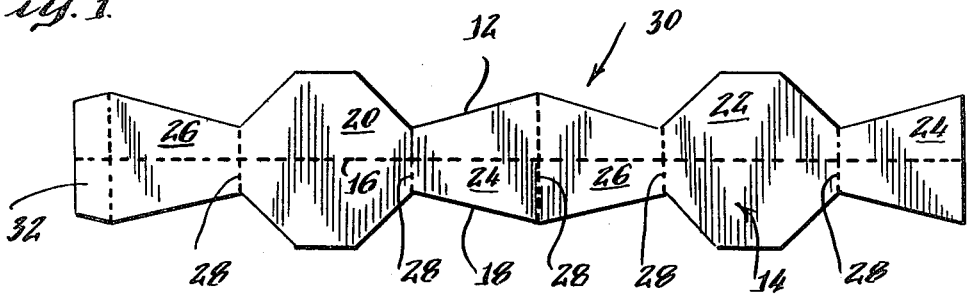
FIG. 1 is a plan view of a blank for forming the container unitizing sleeve and support of the present invention.
Figure 2:
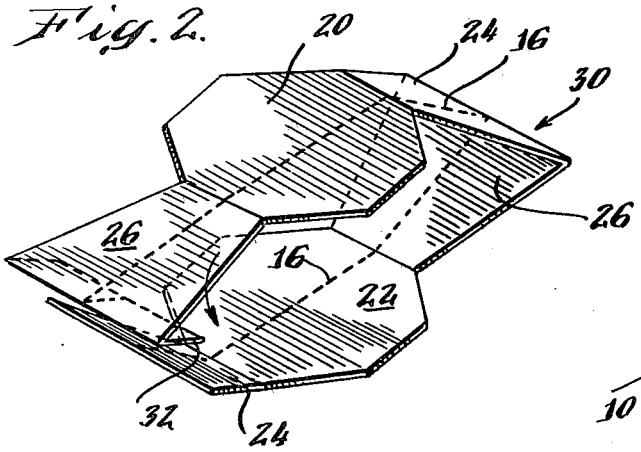
FIG. 2 is a perspective view illustrating how the blank of FIG. 1 is folded to form the sleeve of the present invention.
Figure 3:
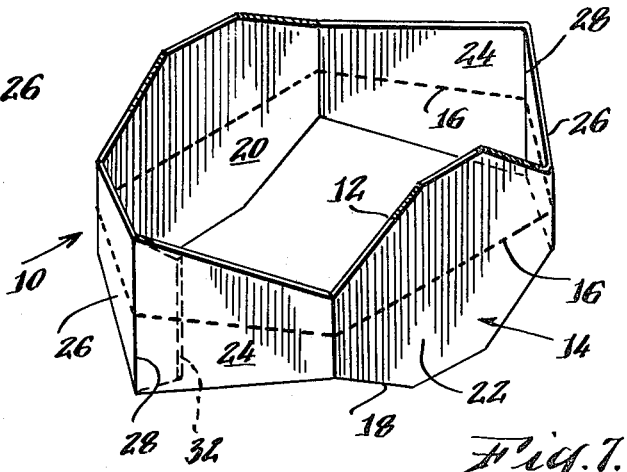
FIG. 3 is a perspective view of the sleeve of the present invention.

As shown in FIGS. 1 and 2, the binder sleeve 10 is formed from a blank generally designated by the numeral 30.

Blank 30 includes the elongated paperboard strip 14 and the opposed undulating edges 12 and 18 between which are disposed panels 26, 20, 24, 26, 22 and 24 in sequence. The blank 30 is bisected by perforated score line 16. Each of the panels 26, 20, 24, 26, 22 and 22 and 24 is separated from an adjacent panel by a hinge or score line 28. The edge of one of the panels 26 additionally contains a tab 32 which can be adhesively joined to the inner surface of one of the panels 24, as shown in FIG. 2, after the strip 14 is bent about each score line 28, to form the paperboard strip into its endless tubular configuration, with a pair of trapezoidal panels 24, 26 between octagonal panels 20 and 22.

Figure 7:
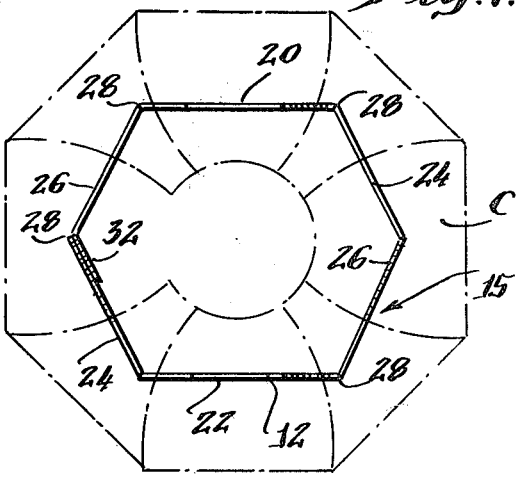
FIG. 7 is a top plan view of the support sleeve of FIG. 6.
Figure 6:
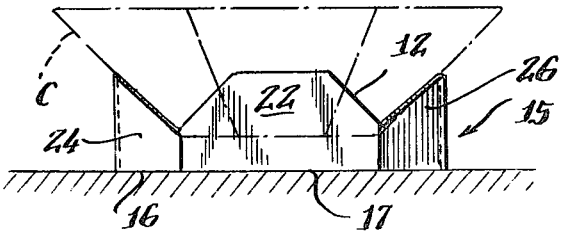
FIG. 6 is a side view in elevation of one-half of the sleeve of FIG. 3 used to support a container illustrated in phantom, above a plane surface.

After removal of the sleeve 10 from containers C and C', the sleeves 10 perform the additional function illustrated in FIGS. 6 and 7. Sleeve 10 is separated into two pieces along perforated score line 16 and one half 15 can be positioned in a microwave oven on a horizontal surface in contact with the linear edge 17 left by the score line 16, while the undulating edge 12 formed of the peaks and valleys provided by half of panels 20, 22, 24 and 26, can support one of the containers C and C' above the floor of the oven. This permits better distribution of the microwave energy of the oven about the container, resulting in increasing the volume and quality of the cooked product to be held within the container.

Since one half of panels 20 and 22 are semi-octagonal in shape, and panels 24 and 26 are trapezoidal in shape joined along a common base, the requisite peaks and valleys for supporting the container C or C' are formed on sleeve 10 to provide the support of the container C or C' above a plane surface.

What is claimed as new is:

1. A binder sleeve for holding a pair of food containers together as a unitized package in front-to-front juxtaposition and for supporting at least one of said containers above a plane surface for microwave energy distribution to the underside thereof comprising:

a tube formed from an endless paperboard strip having a pair of opposed undulating edges and a perforated score line bisecting the strip positioned equidistant from said undulating edges, an undulating edge of said strip providing a raised seat for a container above a plane surface when said strip is separated along said score line and supported on the edge formed by said perforated score line.

2. The sleeve of claim 1 wherein said undulating edges contain peaks and valleys.

3. The sleeve of claim 2 wherein some of said peaks are higher than others.

4. The sleeve of claim 3 wherein said endless paperboard strip includes a plurality of panels joined to each other along common score lines, at least some of said opposed panels in said tube being in the shape of a regular polygon.

5. The sleeve of claim 4 wherein said polygonal shape is an octagon.

6. The sleeve of claim 4 wherein at least some of said opposed panels are two trapezoidal panels joined along a common base.

* * * * *